United States Patent [19]

Smrt

[11] 3,985,290

[45] Oct. 12, 1976

[54] FOLDED BAG HANDLE

[76] Inventor: Thomas John Smrt, 31W 300 W. Bartlett Road, Bartlett, Ill. 60103

[22] Filed: Aug. 25, 1975

[21] Appl. No.: 607,438

[52] U.S. Cl. ..... 229/54 R; 150/12; 229/62

[51] Int. Cl.[2] ..... B65D 33/06

[58] Field of Search ..... 229/54 R, 53, 62; 150/12, 1.7

[56] References Cited

UNITED STATES PATENTS 1,731,340 10/1929 Lambert ..... 229/53 X 3,858,789 1/1975 Verbeke ..... 150/12 X

*Primary Examiner*—Stephen P. Garbe

[57] ABSTRACT

A carrying handle for a bag is formed from a sheet of material. The sheet is first folded approximately in half about a first fold line, and then the upper portion of the folded sheet is folded about a second fold line extending generally perpendicularly to the first fold line to provide a pocket below the second fold line. The upper corners of the pocket are folded and secured about fold lines extending generally diagonally across the corners. A bag can be inserted and secured between the lower portions of the folded sheet.

2 Claims, 8 Drawing Figures

FOLDED BAG HANDLE

BACKGROUND AND SUMMARY

This invention relates to a carrying handle for a bag, and, more particularly, to a carrying handle which is formed from sheet material.

Plastic bags are becoming increasingly popular for displaying and storing merchandise and the like. The contents of the bag are visible through the bag, and the merchandise does not have to be packaged after the sale. However, there is a need for a convenient, inexpensive carrying handle for bags made of plastic and other materials which can be secured to the bag either before or after sale.

The invention provides a carrying handle for bags which is very inexpensive yet which can be easily formed and attached to the bag. The handle is folded from sheet material such as paperboard, and, because of the manner of folding the sheet material, the sheet can be preprinted with advertising, directions, or the like.

DESCRIPTION OF THE DRAWING

The invention will be explained in conjunction with an illustrative embodiment shown in the accompanying drawing, in which.

DESCRIPTION OF SPECIFIC EMBODIMENTS

Figure 1:
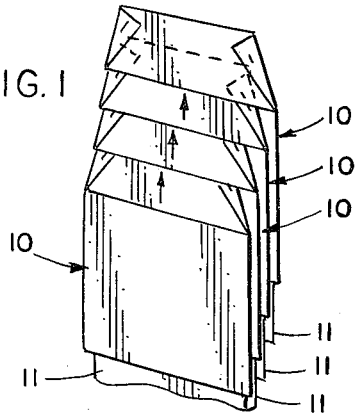
FIG. 1 is a fragmentary perspective view of a plurality of bag handles formed in accordance with the invention which are interfitted or stacked with one another.
Figure 2:
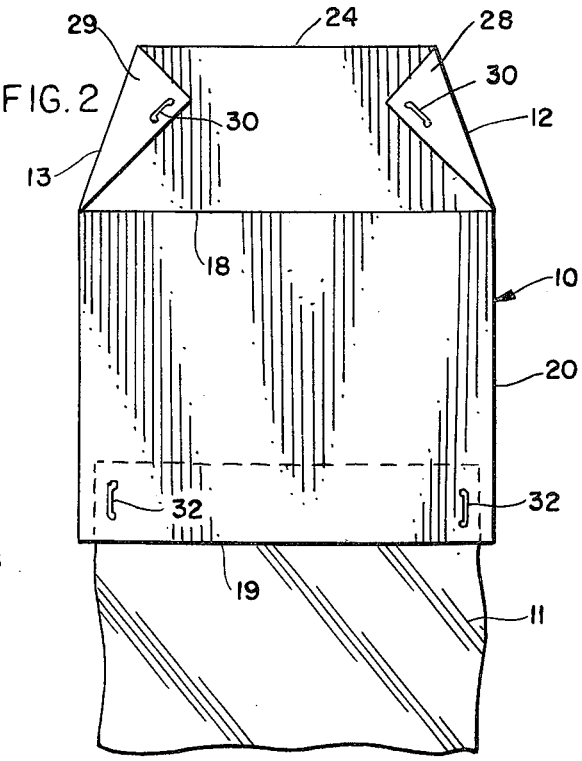
FIG. 2 is a fragmentary plan view of a bag handle and an attached bag.
Figure 3:
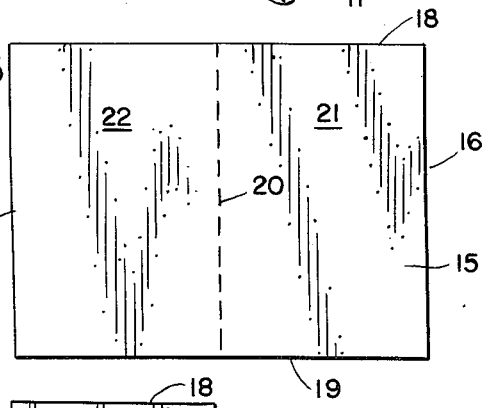
FIG. 3 is a plan view of a sheet used to form the bag handle.
Figure 8:
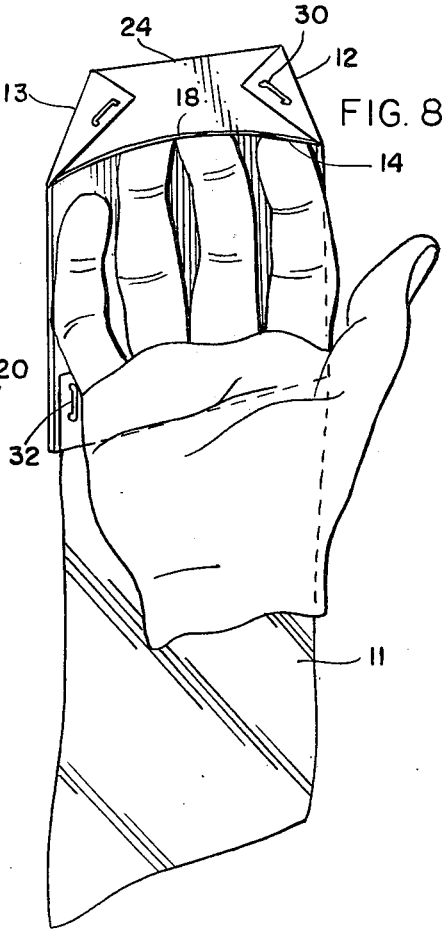
FIG. 8 is a perspective view showing the manner in which the handle and bag can be carried.

The numeral 10 designates generally a bag handle which is secured to the top of a bag 11. The upper end of each of the handles includes a pair of converging or tapered sides 12 and 13 and a pocket 14 (FIG. 8). The tapered sides permit the upper end of each handle to be inserted into the pocket of another handle so that a plurality of handles can be stacked or carried as illustrated in FIG. 1.

Figure 4:
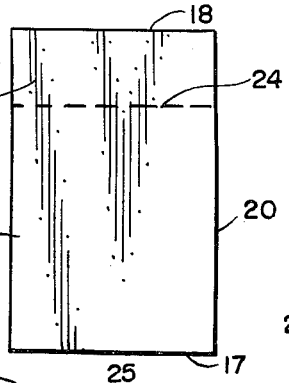
FIG. 4 is a plan view of the sheet of FIG. 3 after the first folding step.
Figure 5:
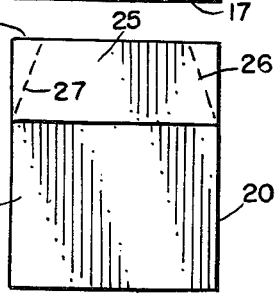
FIG. 5 is a plan view of the sheet of FIG. 4 after the second folding step.
Figure 6:
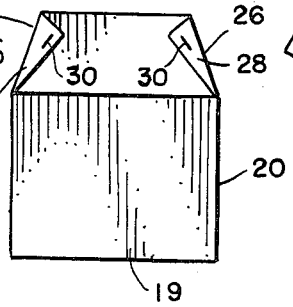
FIG. 6 is a plan view of the sheet of FIG. 5 after the third and fourth folding steps.

The method of forming the bag handle is illustrated in FIGS. 3–6. A rectangular sheet 15 of paper, paperboard, or similar material includes side edges 16 and 17 and top and bottom edges 18 and 19. The sheet is first folded about a fold line, indicated by the dotted line 20 in FIG. 3, which extends along the middle of the sheet parallel to the side edges to form a pair of overlapping sheet portions or halves 21 and 22. The folded sheet is shown in FIG. 4, and an upper portion 23 of the folded sheet is folded about a second fold line 24 which extends generally parallel to the top edge and generally perpendicular to the first fold line 20 and the overlapped side edges. The double-folded sheet is illustrated in FIG. 5, and the corners of the double-folded upper portion 25 of the sheet are folded about third and fourth fold lines 26 and 27. The fold line 26 extends diagonally or angularly between the fold line 20 and the fold line 24, and the fold line 27 extends angularly between the overlapped side edges of the sheet and the fold line 24. The folded corner portions 28 and 29 are secured by staples 30 which pass through all eight layers of the folded sheet material.

The upper portion 23 (FIG. 4) of the single-folded sheet forms the pocket 14 between the portion 23 and the remainder of the single-folded sheet when the upper portion is folded about the fold line 24. The pocket is secured by the staples 30, and the sheets which form the pocket can be spread apart to accommodate the fingers of a hand as shown in FIG. 8.

Figure 7:
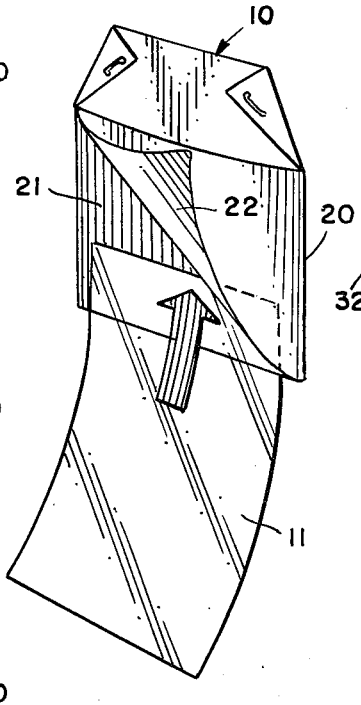
FIG. 7 is a perspective view showing the manner of attaching the bag to the handle.

The lower portion of the handle remains single-folded, and the upper end of the bag 11 can be inserted between the sheet halves 21 and 22 as shown in FIG. 7. The bag is then secured to either or both of the sheet halves. In the embodiment illustrated the bag is secured to both sheet halves by a pair of staples 32. The upper end of the bag need not be sealed or closed before it is attached to the handle, and the staples 32 and the handle serve to close the bag.

The bag can be formed of clear plastic or other desired material, and can be used to package and display items at the point of purchase. The handle serves both as a bag closure and hanger, and after the sale the purchaser can use the handle to carry the bag. A number of bags can be hung or carried by inserting the tapered upper end of each handle into the pocket of another handle as shown in FIG. 1.

I have found that the bag handle is particularly useful at expositions, trade shows, fairs, and the like when the attendees carry many small items for long periods of time. The items which are sold or given away by the exhibitors do not have to be pre-bagged, and each item can be bagged and provided with a handle quickly and at a low cost. In such a case the handles are conveniently pre-formed, and the bags are inserted into and attached to the handles as needed. However, since the handles can be formed so easily, it is possible to form each handle as needed.

The sheet material can be printed with advertising material, directions for using the bagged items, etc. before the handle is formed. Since the sheet is folded in a particular way, those portions of the sheet which will be visible when the handle is completed are known and can be printed as desired. All of the outside surfaces on both sides of the handle are on the same surface of the unfolded sheet 15. For example, comparing FIGS. 3 and 7, the handle was formed by folding the sheet half 21 behind the sheet half 22. All of the outer or visible surfaces of the completed handle are therefore provided by the upper surface of the unfolded sheet 15, i.e., the surface which faces the viewer in FIG. 3. Thus, only one side of the unfolded sheet need be printed in order to have printing on both sides of the handle.

While in the foregoing specification, a detailed description of a specific embodiment of the invention was set forth for the purpose of illustration, it is to be understood that many of the details hereingiven may be varied considerably by those skilled in the art without departing from the spirit and scope of the invention.

I claim:

1. A handle-equipped bag comprising a carrying handle formed from a sheet of folded material, the sheet being folded approximately in half about a first fold line to provide a pair of overlapping sheet portions having a folded edge and a pair of generally overlapping edges opposite the folded edge, the folded sheet having an upper portion and a lower portion, the upper portion being folded about a second fold line extending generally perpendicularly to the first fold line to provide a pocket between the upper portion and the lower portion, means securing the folded upper portion to the lower portion, and a bag having an upper end inserted into the lower portion of the handle between the overlapping sheet portions and means securing the upper end of the bag to at least one of the overlapping sheet portions whereby the bag can be held and carried by the carrying handle.

2. The structure of claim 1 in which a first portion of the folded upper portion and the lower portion adjacent the second fold line is folded about a third fold line extending angularly between the first fold line and the second fold line and a second portion of the folded upper portion and the lower portion adjacent the second fold line is folded about a fourth fold line extending angularly between the overlapping edges of the overlapping sheet portions and the second fold line, and means securing the first and second portions.

* * * * *